US010316551B2

(12) United States Patent
Regnault et al.

(10) Patent No.: US 10,316,551 B2
(45) Date of Patent: Jun. 11, 2019

(54) APPARATUS AND METHOD FOR PREVENTING UNDESIRED LATCH RELEASE

(71) Applicants: Christian Regnault, Saint-Dié des Vosges (FR); Mathias Barth, Azerailles (FR)

(72) Inventors: Christian Regnault, Saint-Dié des Vosges (FR); Mathias Barth, Azerailles (FR)

(73) Assignee: INTEVA PRODUCTS, LLC, Troy, MI (US)

( * ) Notice: Subject to any disclaimer, the term of this patent is extended or adjusted under 35 U.S.C. 154(b) by 367 days.

(21) Appl. No.: 14/595,022

(22) Filed: Jan. 12, 2015

(65) Prior Publication Data

US 2015/0197966 A1 Jul. 16, 2015

Related U.S. Application Data

(60) Provisional application No. 61/925,853, filed on Jan. 10, 2014.

(51) Int. Cl.

| | |
|---|---|
| ***E05C 3/06*** | (2006.01) |
| ***E05B 77/04*** | (2014.01) |
| *E05B 79/20* | (2014.01) |

(52) U.S. Cl.

CPC ..... *E05B 77/04* (2013.01); *E05B 79/20* (2013.01); *Y10T 292/108* (2015.04)

(58) Field of Classification Search

CPC .. E05B 85/02; Y10T 70/5889; Y10T 70/7102; Y10S 292/23; Y10S 292/65

See application file for complete search history.

(56) References Cited

U.S. PATENT DOCUMENTS

| | | | | |
|---|---|---|---|---|
| 5,277,461 | A | 1/1994 | Dzurko et al. | |
| 5,308,130 | A | 5/1994 | Lee | |
| 6,053,543 | A * | 4/2000 | Arabia, Jr. | E05B 81/06 292/201 |

(Continued)

*Primary Examiner* — Mark A Williams

(74) *Attorney, Agent, or Firm* — Cantor Colburn LLP

(57) ABSTRACT

A latch is provided. The latch having: a claw pivotally mounted to the latch for movement between an unlatched position and a latched position; a pawl pivotally mounted to the latch for movement between an engaged position and a disengaged position, wherein the pawl prevents movement of the claw into the unlatched position from the latched position when the pawl is in the engaged position and wherein the claw is able to move into the unlatched position from the latched position when the pawl is in the disengaged position; a release lever pivotally mounted to the latch for movement between a first position and a second position and operatively coupled to the pawl, wherein movement of the release lever from the first position to the second position moves the pawl from the engaged position to the disengaged position; and a housing having a back plate, each of the claw, the pawl, and the release lever being rotatably mounted to the back plate, the back plate including a back plate leg configured to transform from a un-deformed position to a deformed position in response to an impact applied to the latch, wherein the back plate leg interferes with movement of the release lever from the first position to the second position when it is in the deformed position.

9 Claims, 4 Drawing Sheets

(56) References Cited

U.S. PATENT DOCUMENTS

| | | | | |
|---|---|---|---|---|
| 6,557,688 | B2 * | 5/2003 | Minasian | E05B 81/25<br>192/223 |
| 8,398,128 | B2 | 3/2013 | Arabia et al. | |
| 2005/0040658 | A1 * | 2/2005 | Larsen | E05B 81/14<br>292/229 |
| 2007/0210588 | A1 * | 9/2007 | Cetnar | E05B 77/26<br>292/216 |
| 2011/0278867 | A1 * | 11/2011 | Watanabe | E05B 81/06<br>292/341.16 |

* cited by examiner

APPARATUS AND METHOD FOR PREVENTING UNDESIRED LATCH RELEASE

CROSS REFERENCE TO RELATED APPLICATIONS

This application claims the benefit of U.S. Provisional Patent Application Ser. No. 61/925,853, filed Jan. 10, 2014, the entire contents of which are incorporated herein by reference thereto.

TECHNICAL FIELD

Exemplary embodiments of the present invention relate generally to latch mechanisms and, more particularly, to operation of latch mechanism during and/or after application an excessive force to the latch and/or a vehicle the latch is secured to.

BACKGROUND

A vehicle frequently includes displaceable panels such as doors, a hood, a trunk lid, a hatch, and the like which are affixed for hinged or sliding engagement with the vehicle structure of a vehicle body. Cooperating systems of latches and strikers are typically provided to ensure that such panels remain secured in their fully closed position when a panel is closed.

A door latch typically includes a fork bolt or claw that is pivoted between an unlatched position and a primary latched position when the door is closed to latch the door in the closed position. The claw is typically held in the primary latched position by a detent or pawl that pivots between an engaged position and a disengaged position. The pawl is spring biased into the engaged position and thus, holds the claw in the primary latched position when in the engaged position and releases the claw when it is moved to the disengaged position so that the door can be opened. The claw is pivoted to the primary latched position by a striker attached to, for example, an associated door jamb when the door is closed. Once in the primary latched position, the pawl engages the claw to ensure the assembly remains latched.

In order to open a vehicle door, an outer door handle is coupled to a release lever by a cable. Application of an extreme force to the vehicle panel and/or the corresponding latch secured thereto may be transferred to the release cable, thereby causing the release lever to actuate the pawl and open the latch and/or unlatch the panel from the vehicle. For example, during a vehicle crash door sheet metal or other parts may shear and may create a pulling force on the release cable and thus manipulate the release lever which is operatively coupled to other components of the latch.

Accordingly, it is desirable to provide a latch wherein unintended movement of the release lever is limited to prevent undesired opening of a vehicle panel and/or its associated latch.

SUMMARY OF THE INVENTION

In accordance with an embodiment, a latch is provided. The latch having: a claw pivotally mounted to the latch for movement between an unlatched position and a latched position; a pawl pivotally mounted to the latch for movement between an engaged position and a disengaged position, wherein the pawl prevents movement of the claw into the unlatched position from the latched position when the pawl is in the engaged position and wherein the claw is able to move into the unlatched position from the latched position when the pawl is in the disengaged position; a release lever pivotally mounted to the latch for movement between a first position and a second position and operatively coupled to the pawl, wherein movement of the release lever from the first position to the second position moves the pawl from the engaged position to the disengaged position; and a housing having a back plate, each of the claw, the pawl, and the release lever being rotatably mounted to the back plate, the back plate including an back plate leg configured to transform from a un-deformed position to a deformed position in response to an impact applied to the latch, wherein the back plate leg interferes with movement of the release lever from the first position to the second position when it is in the deformed position.

According to another embodiment of the present invention, a method of preventing undesired opening of a latch when a force is applied to the latch. The method including the steps of: transforming a back plate leg formed integrally with a back plate of the latch from a coplanar position with respect to the back plate to a deformed non-coplanar position with respect to the back plate in response to an impact applied to the latch; and inhibiting rotation of a release lever of the latch from a first non-actuated position to a second actuated position when the back plate leg is in the deformed position.

In yet another embodiment, a vehicle latch is provided. The vehicle latch having: a back plate; a pawl rotatably mounted to the back plate; a claw rotatably mounted to the back plate, wherein the pawl cooperates with the claw to allow or inhibit movement of the claw based upon a position of the pawl; an outside release lever rotatably mounted to the back plate, the outside release lever being operatively coupled to an outside release handle via a cable, wherein actuation of the outside release handle causes the outside release lever to move from a first position to a second position via the cable and wherein movement of the outside release lever from the first position to the second position causes a corresponding movement of the pawl; and wherein the back plate further comprises a deformable member proximate to the outside release lever, the deformable member when in an un-deformed position is coplanar with the back plate and does not interfere with movement of the pawl and when the deformable member is in a deformed position, the deformable member prevents movement of the release lever from the first position to the second position.

The above-described and other features and advantages of the present invention will be appreciated and understood by those skilled in the art from the following detailed description, drawings, and appended claims.

BRIEF DESCRIPTION OF THE DRAWINGS

Embodiments of the present invention will now be described, by way of example only, with reference to the accompanying drawings in which.

DETAILED DESCRIPTION

Reference is made to the following U.S. Pat. Nos. 5,277,461; 5,308,130; 6,053,543; and 8,398,128, the entire contents each of which are incorporated herein by reference thereto.

Figure 1:
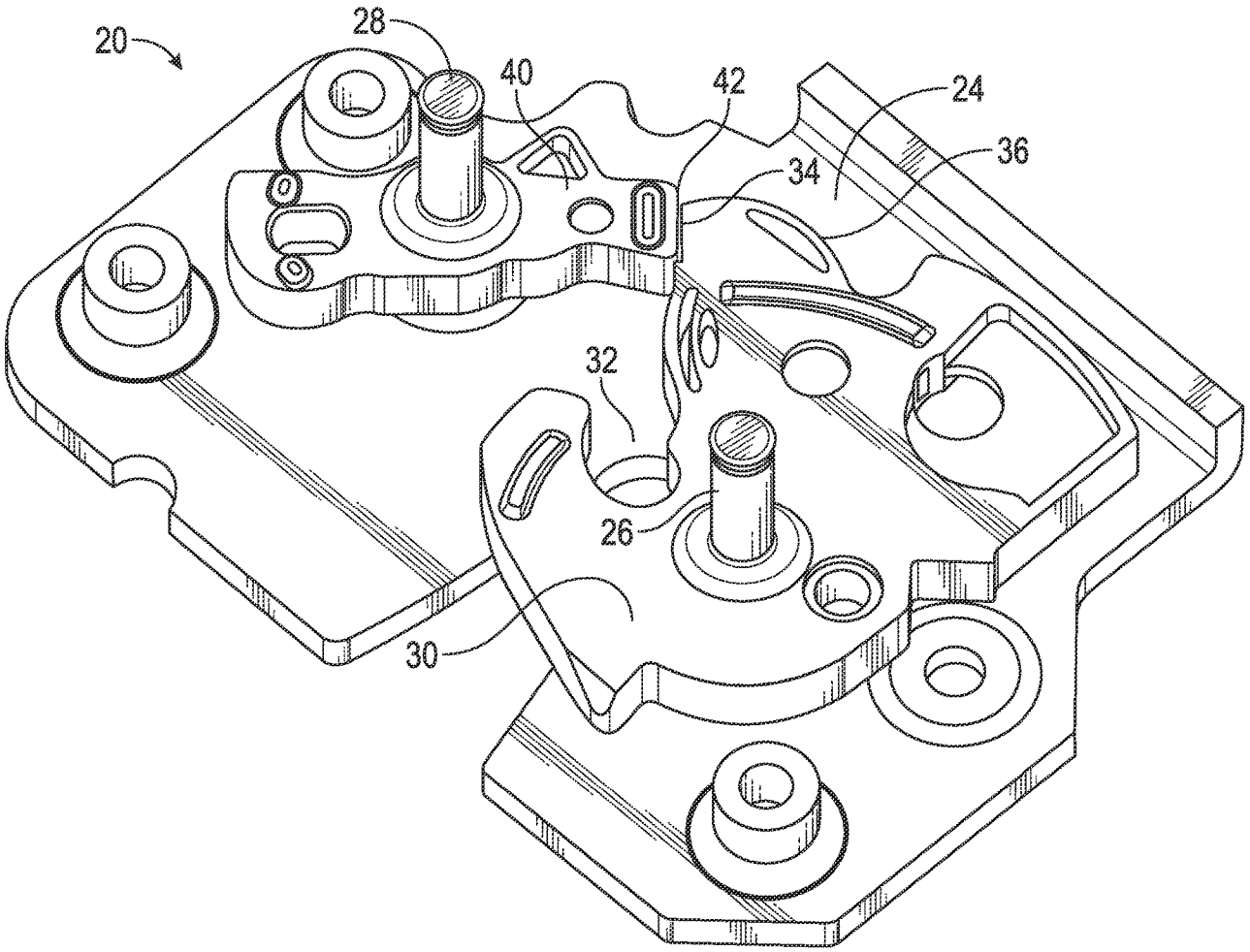
FIG. 1 is a perspective view of portions of a latch assembly.
Figure 2:
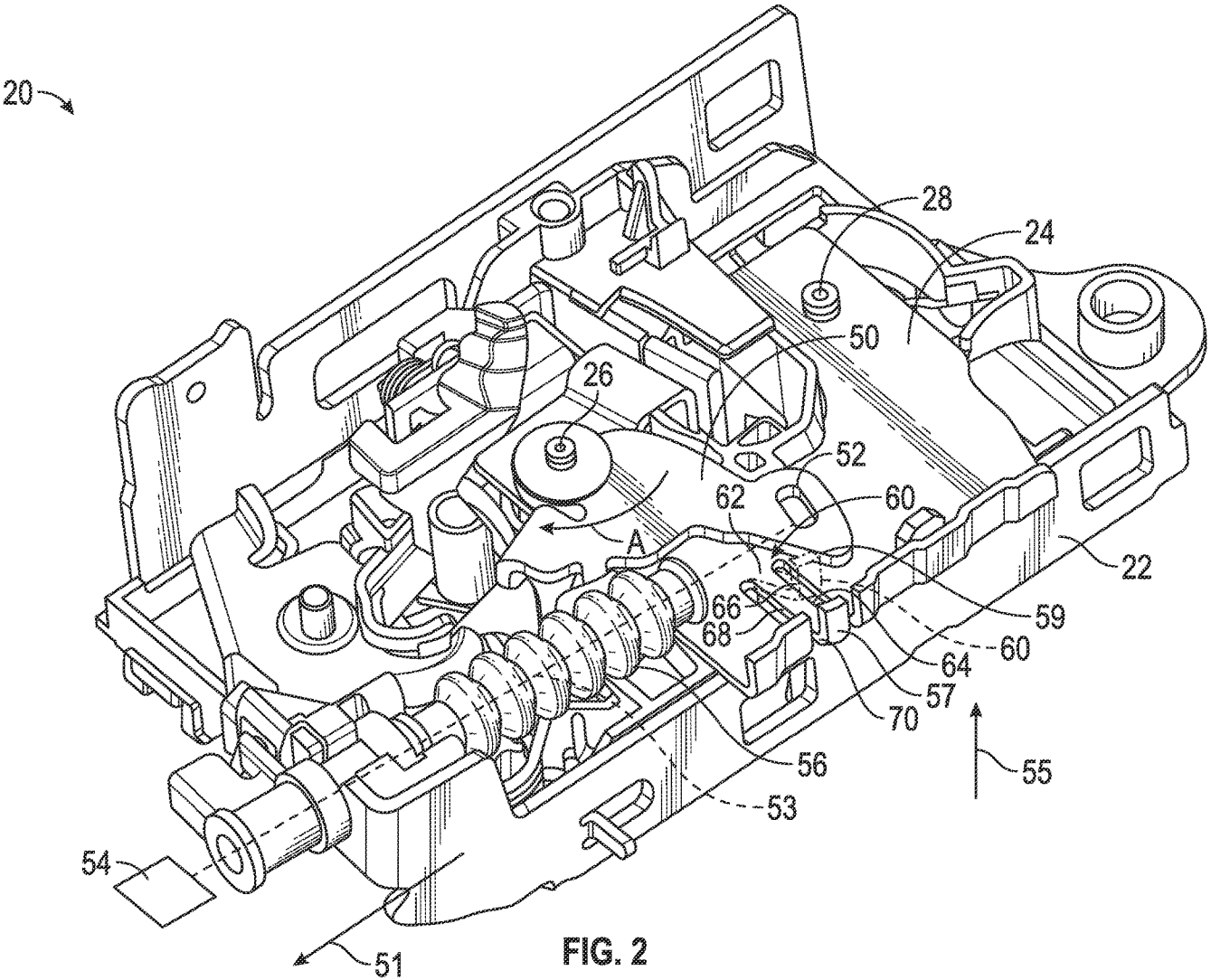
FIG. 2 is a perspective view of an interior of a latch assembly according to an embodiment of the invention.
Figure 3:
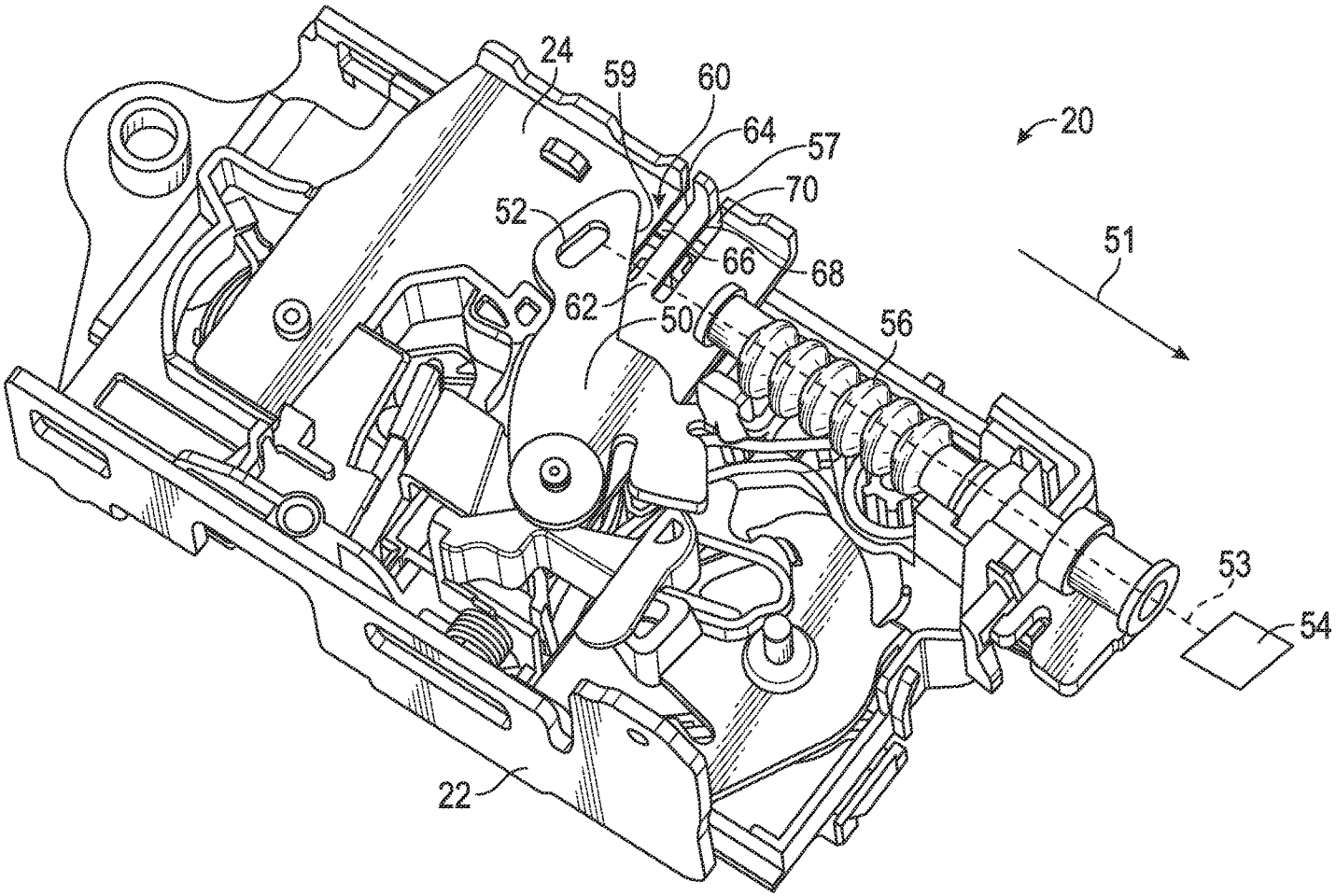
FIG. 3 is another perspective view of an interior of a latch assembly according to an embodiment of the invention.
Figure 4:
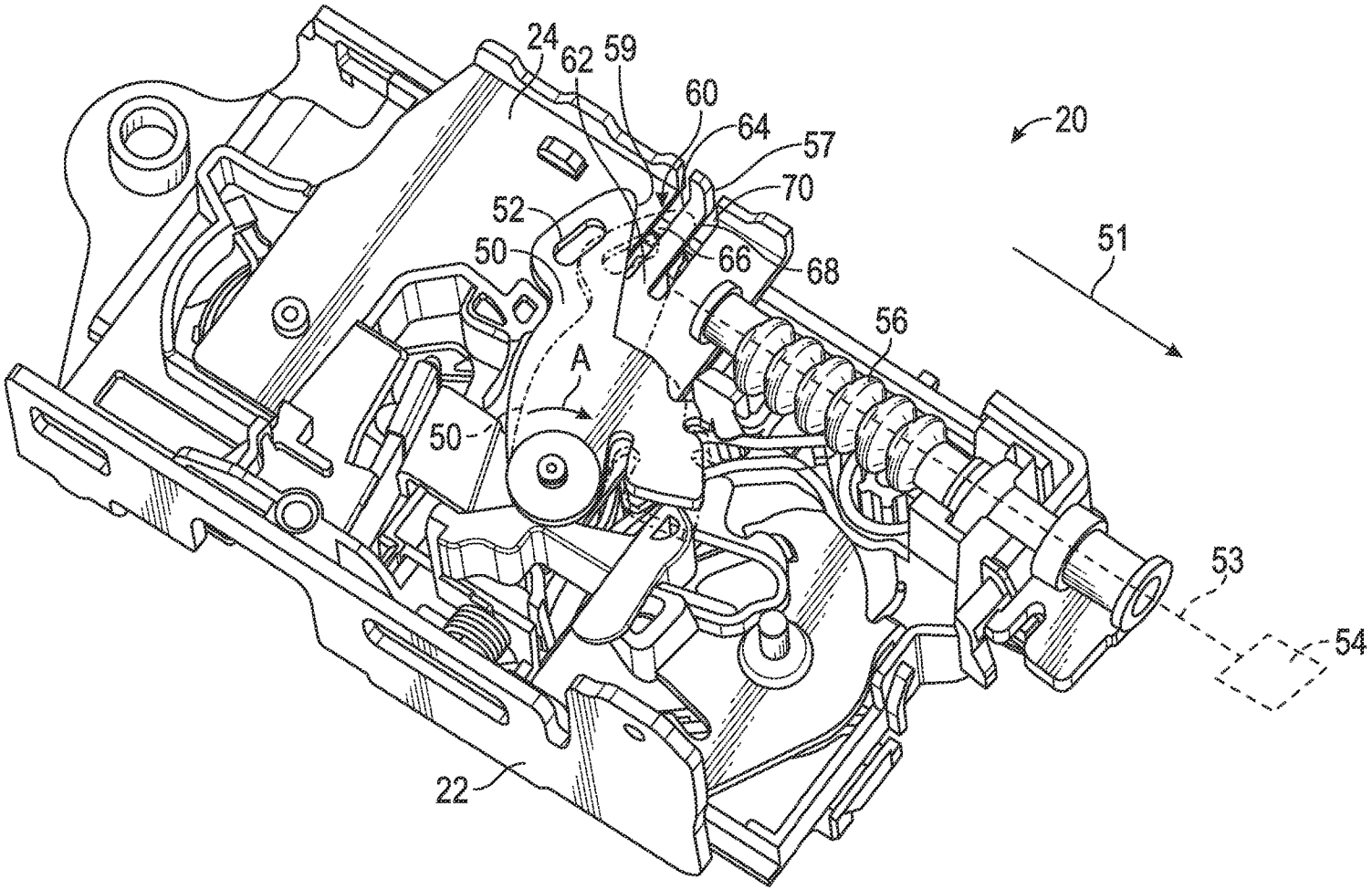
FIG. 4 is a perspective view illustrating movement of the release lever.

Referring now to the FIGS., an example of a latch or latch assembly 20 is illustrated. FIG. 1 illustrates portions of the latch or latch assembly 20. This latch 20 may be integrated into a component of a vehicle, such as the vehicle door, trunk, or any other operable component for example. The latch 20 includes a multi-piece enclosure comprising a housing 22 connected to a back plate 24 (FIGS. 2-4). The housing 22 and back plate 24 are commonly held together by at least a first and second pivot pin 26, 28, each of which is inserted through aligned holes (not shown) in the housing 22 and back plate 24.

The latch 20 additionally includes a fork bolt or claw 30 and a cooperating detent or pawl 40 (FIG. 1). The claw 30 and pawl 40 are pivotally mounted to the back plate 24 by the first and second pivot pin 26, 28, respectively. The claw 30 is configured to rotate between an open, unlatched position and a closed, latched position. The pawl 40 cooperates with the claw 30 in a known manner to retain the claw 30 in the closed position or release the claw 30 for return to the open position. That is, the pawl 40 pivots between a first, engaged position and a second, disengaged position.

The latch 20 may be integrated into a portion of a vehicle, such as the vehicle structure (not shown) for example, such that the claw 30 moves between the open position and the closed position when a door, window, lift gate, etc. is opened and closed and the claw engages a striker (not shown) attached to the door, window, lift gate, etc. Alternatively, the latch 20 may be secured to the door, window, lift gate etc. and the striker (not shown) may be secured to the vehicle structure at an opening into which the door, window, lift gate etc. is received. Cooperation of the claw 30 and striker (not shown) is well known and need not be described in detail.

In one embodiment, the claw 30 may be biased into the open position by a biasing mechanism (not shown), such as by a torsion spring for example, and the pawl 40 may be similarly biased into engagement with the claw 30 by another biasing mechanism (not shown). The claw 30 has a slot or throat 32 for receiving and retaining the striker (not shown) located on a complementary vehicle component. In an exemplary embodiment, the claw 30 includes at least a primary shoulder 34. The pawl 40 includes a first leg 42 that positively engages the primary shoulder 34 of the claw 30 to hold the claw 30 against a biasing force in a latched position.

When the claw 30 rotates between an open, unlatched position and a closed, latched position, a portion 36 of the claw 30 contacts the first leg 42 of the pawl 40 and applies a rotational force thereto in a direction opposite the biased direction of rotation of the pawl 40. This rotational force causes the pawl 40 to rotate about pivot pin 28 such that the first leg 42 of the pawl 40 pivots out of engagement with the claw 30. The biasing force of the biasing mechanism (not shown) causes the first leg 42 of the pawl 40 to rotate back into engagement with the claw 30 to contact the primary shoulder 34.

Referring now to FIGS. 2-4, a release lever or outside release lever 50 is similarly mounted about the pivot pin 26 for rotation relative to the back plate 24 between a first or neutral position and a second or actuated position. In one embodiment, a first end 52 of the release lever or outside release lever 50 is operably coupled to a handle (illustrated schematically at 54), such as an external or exterior handle mounted on an exterior of a vehicle or vehicle door for example, via a release cable 53 (illustrated by the dashed lines) that passes through a cable guide or cable end fitting 56 secured to the latch 20. Upon operation of the handle 54, a force is transmitted to the first end 52 of the release lever 50 by for example movement of the release cable in the direction of arrow 51, which in turn causes the release lever or outside release lever 50 to pivot from a first position, in a direction indicated by arrow A, to a second actuated position (See at least FIG. 4). As the release lever 50 rotates from the first position to the second position, the release lever 50 is configured to engage a portion (not shown) of the pawl 40 and thus rotate the pawl from the engaged position to the disengaged position. As a result, the rotation of the release lever 50 causes the first leg 42 of the pawl 40 to disengage from the primary shoulder 34 of the claw 30 thereby allowing the claw 30 to rotate open to an unlatched position.

The back plate 24 is configured to provide structural support to the latch 20 and is formed from a robust material, such as steel for example. Of course, other suitable materials are contemplated in accordance with various embodiments of the present invention. The back plate 24, as illustrated in FIGS. 2-4, includes a back plate leg or member 60 integrally formed with the back plate 24 at a first end 62, proximate to the first end 52 of the release lever 50. A first side 64 of the back plate leg 60 is separated from an adjacent portion of the back plate 24 by a first gap 66, and a second, opposite side 68 of the back plate leg 60 is separated from an adjacent portion of the back plate 24 by a second gap 70. The first gap 66 and the second gap 70 may be generally equivalent in size, or alternatively, may vary in size. During normal operation of the latch 20, the back plate leg 60 is substantially coplanar with the back plate 24.

The back plate leg or member 60 is configured to transform from an un-deformed position coplanar with the back plate 24 to a deformed position when the energy of an impact, such as generated during a collision of the vehicle to which the latch 20 is mounted, is applied to the back plate 24. In response to the impact, the back plate leg or member 60 may bend or deform about its first end 62, out of the plane of the back plate 24 in the direction of arrow 55 towards the first end 52 of the release lever 50. As an end 57 of the leg or member 60 moves upward in the direction of arrow 55 it may be repositioned into the position illustrated at least by the dashed lines in FIG. 2. At this position, the first side 64 of leg or member 60 is in a position to contact a surface 59 of the release lever 50 and inhibit movement of the release lever 50 in the direction of arrow A towards the second actuated position. Thus, when in the deformed position (e.g., out of plane with back plate 24) the back plate leg or member or deformable member 60 will prevent or inhibit movement of the outside release lever 50 from the first position towards the second position in the direction of arrow A.

The size, shape, and orientation of the back plate leg 60 may be selected to optimize the deformation of the back plate leg 60 based on a position and magnitude of the force applied to the latch 20. Still further, the configuration and/or location of the back plate leg or member or deformable member 60 may be varied or adjusted to be deformed based upon different types of impacts applied to the latch 20 and/or back plate leg, member or deformable member 60.

As illustrated in at least FIGS. 2-4, the back plate leg or member 60 may extend to a peripheral edge of the back plate 24 and in one embodiment, the end 57 may comprising an upturned end portion located proximate to the peripheral edge of the back plate 24. Alternatively, the back plate leg or member 60 may not comprise an upturned end portion and/or may not extend to the peripheral edge of the back plate 24. In some embodiments, at least a portion of the upturned end portion 57 may comprise a portion or alternatively is the portion of the first side 64 that contacts the release lever 50 when the back plate leg 60 is in the deformed position and the release lever moves from the first position towards the second position. In other embodiments, the portion of the first side 64 that contacts the release lever 50 when the back plate leg 60 is in the deformed position may not include the upturned end portion 57 (e.g., the contact portion may include a portion of the first side 64 that does not include the upturned end portion). It being understood that various embodiments of the present invention contemplate numerous configurations of the back plate leg or member 60 that contacts the release lever when it is in the deformed position.

When in the deformed position, the back plate leg or member 60 is configured to interfere with the rotation of the release lever 50 to either stop or slow the rotation of the release lever 50 toward the second actuated position. As mentioned above an impact or excessive force to the vehicle and/or latch 20 may sometimes apply a force to the release cable 53 (illustrated by the dashed lines) due to an element or elements being deformed during this impact or application of excessive force thereby causing a pulling force on the release cable 53 in the direction of arrow 51, which in turn may cause the release lever 50 to rotate in the direction of arrow A from a neutral or first position towards the second or actuated position. However and by locating the back plate leg or member or deformable member 60 in the back plate 24 the element or elements or additional elements being deformed during this impact or application of excessive will move the back plate leg or deformable member 60 into a deformed position that will be in the path of travel of the release lever 50 and thus, the back plate leg or member or deformable member 60 prevents the rotation of the release lever towards the second or actuated position and thus prevents opening of the latch 20 via movement of outside release lever or lever 50. The element or elements or additional elements being deformed during an impact or application of excessive force to the vehicle and/or latch may be the same ones that deform the back plate leg or member or deformable member 60 as well as apply the force to the release cable 53 in the direction or arrow 51. Alternatively, different elements or additional elements deformed during an impact or application of excessive force to the vehicle and/or latch will deform the back plate leg or deformable member 60 as opposed to those that apply the force to the release cable in the direction or arrow 51.

It being understood that while back leg or member or deformable member 60 is in the blocking position, the latch 20 may still be opened by an inside release lever (not shown) that is operably coupled to an inside release handle (not shown). The inside release handle being mounted on an interior surface of the vehicle. In other words and in one embodiment, leg or member or deformable member 60 may only interfere with the operation of the release lever or outside release lever 50 coupled to the outside release handle 54 (located on an exterior surface of the vehicle) when it is in the blocking position illustrated by for example, the dashed lines in FIG. 2.

It being understood, that as the release lever 50 is rotated or moved from the first or unactuated position to the second or actuated position in the direction of arrow A due to operation of the handle 54 and movement of cable 53 in the direction of arrow 51 at least a portion of the release lever 50 will have to travel past the back plate leg or member 60 (See at least FIG. 4), which is possible when the back plate leg or member 60 is co-planar with respect to the back plate 24 (See at least the dashed lines in FIG. 4). Thus, opening of the latch 20 is possible via movement of the release lever 50 when the back plate leg or member 60 is co-planar with the back plate 24. In other words, desired operation of the latch 20 is not interfered with when the back plate leg or member 60 is co-planar or in a non-blocking position with respect to the back plate 24.

By including a back plate leg or member 60 adjacent the outside release lever or release lever 50, desired opening of the latch 20 or movement of the outside release lever or release lever 50 during a vehicle collision is reduced as the back plate leg or member 60 can be deformed into a non-coplanar blocking position with respect the back plate 24.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A latch, comprising:

a housing having a back plate a claw pivotally mounted to the back plate for movement between an unlatched position and a latched position;

a pawl pivotally mounted to the back plate for movement between an engaged position and a disengaged position, wherein the pawl prevents movement of the claw into the unlatched position from the latched position when the pawl is in the engaged position and wherein the claw is able to move into the unlatched position from the latched position when the pawl is in the disengaged position;

a release lever pivotally mounted to the back plate for movement between a first position and a second position and operatively coupled to the pawl, wherein movement of the release lever from the first position to the second position moves the pawl from the engaged position to the disengaged position; and a back plate leg integrally formed with the back plate, the back plate leg having a first portion and an end portion that extends upwardly from a distal end of the first portion, a first gap extending between a first side of first portion of the back plate leg and a first adjacent portion of the back plate, the first gap extending to the distal end of the first portion and a second gap extending between second side, opposite the first side, of the first portion of the back plate leg and a second adjacent portion of the back plate, the second gap extending to the distal end of the first portion, the back plate leg being deformable from the back plate to transition from a un-deformed position to a deformed position in response to an impact applied to the latch, wherein the first portion is substantially co-planar with the first adjacent portion and the second adjacent portion of the back plate when the back plate leg is in the un-deformed position and wherein at least the end portion of the back plate leg interferes with movement of the release lever from the first position to the second position when the back plate leg is in the deformed position.

2. The latch as in claim 1, wherein the latch is integrated into a vehicle and the impact applied to the latch is generated by an impact to a vehicle the latch is secured to.

3. The latch as in claim 1, wherein a first gap is substantially parallel to the second gap.

4. The latch as in claim 1, wherein the end portion of the back plate leg is located at a peripheral edge of the back plate when the back plate leg is in the un-deformed position.

5. The latch as in claim 1, wherein the release lever is an outside release lever operatively coupled to an exterior handle via a cable.

6. The latch as in claim 1, wherein the back plate and the back plate leg are formed from steel.

7. A vehicle latch, comprising:

a back plate;

a pawl rotatably mounted to the back plate;

a claw rotatably mounted to the back plate, wherein the pawl cooperates with the claw to allow or inhibit movement of the claw based upon a position of the pawl;

an outside release lever rotatably mounted to the back plate, the outside release lever being operatively coupled to an outside release handle via a cable, wherein actuation of the outside release handle causes the outside release lever to move from a first position to a second position via the cable and wherein movement of the outside release lever from the first position to the second position causes a corresponding movement of the pawl; and wherein the back plate further comprises a deformable member integrally formed with the hack plate and located proximate to the outside release lever, the deformable member being deformable from an un-deformed position to a deformed position with respect to the back plate such that when the deformable member is in the un-deformed position it is coplanar with the back plate and does not interfere with movement of the pawl and when the deformable member is in the deformed position, the deformable member is no longer coplanar with the back plate and prevents movement of the release lever from the first position to the second position, the deformable member comprising a first portion and an end portion that extends upwardly from a distal end of the first portion;

a first gap extending between a first side of first portion of the deformable member and a first adjacent portion of the back plate, the first gap extending to the distal end of the first portion of the deformable member and a second gap extending between a second side, opposite the first side, of the first portion of the deformable member and a second adjacent portion of the back plate, the second gap extending to the distal end of the first portion, wherein the first portion is substantially co-planar with the first adjacent portion and the second adjacent portion of the back plate when the deformable member is in the un-deformed position.

8. The latch as in claim 7, wherein a first gap is substantially parallel to the second gap.

9. The latch as in claim 8, wherein the end portion of the deformable member is located at a peripheral edge of the back plate when the deformable member is in the un-deformed position.

* * * * *